US007416622B2

(12) United States Patent
Küppers et al.

(10) Patent No.: US 7,416,622 B2
(45) Date of Patent: Aug. 26, 2008

(54) METHOD AND SYSTEM FOR THERMAL TREATMENT OF RAILS

(75) Inventors: Klaus Küppers, Erkrath (DE); Meinert Meyer, Ekrath (DE); Thomas Nerzak, Gelsenkirchen (DE)

(73) Assignee: SMS Meer GmbH, Monchengladbach (DE)

( * ) Notice: Subject to any disclaimer, the term of this patent is extended or adjusted under 35 U.S.C. 154(b) by 328 days.

(21) Appl. No.: 10/489,130

(22) PCT Filed: Sep. 19, 2002

(86) PCT No.: PCT/EP02/10512

§ 371 (c)(1),
(2), (4) Date: Mar. 5, 2004

(87) PCT Pub. No.: WO03/028912

PCT Pub. Date: Apr. 10, 2003

(65) Prior Publication Data

US 2004/0231763 A1 Nov. 25, 2004

(30) Foreign Application Priority Data

Sep. 29, 2001 (DE) ..... 101 48 305

(51) Int. Cl.
*C21D 9/04* (2006.01)

(52) U.S. Cl. ..... 148/581; 148/584; 148/569

(58) Field of Classification Search ..... 148/581, 148/584, 569

See application file for complete search history.

(56) References Cited

U.S. PATENT DOCUMENTS

| | | | | |
|---|---|---|---|---|
| 468,788 | A | 2/1892 | Cloud | |
| 4,375,995 | A * | 3/1983 | Sugino et al. | 148/584 |
| 4,611,789 | A * | 9/1986 | Ackert et al. | 266/81 |
| 4,933,024 | A | 6/1990 | Fukuda et al. | |

FOREIGN PATENT DOCUMENTS

| | | |
|---|---|---|
| DE | 2919156 | * 11/1979 |
| DE | 30 06 695 | 3/1984 |
| DE | 42 37 991 | 5/1994 |
| EP | 0 187 904 | 10/1985 |
| EP | 0 187 904 | 7/1986 |
| EP | 0 612 852 | 2/1994 |
| EP | 0 693 562 | 1/1996 |
| JP | 57137425 | 8/1982 |
| JP | 08252602 | 10/1996 |

* cited by examiner

*Primary Examiner*—Deborah Yee
(74) *Attorney, Agent, or Firm*—Andrew Wilford

(57) ABSTRACT

In order to obtain a fine-lamellar perlite structure in the edge region of the heads of rails (1), especially hot-rolled rails for carriageways or railways, by specific thermal treatment during cooling from the rolling heat without the formation of bainite, precooling (12) occurs in order to achieve a core temperature of approximately 750-850° C., and the temperature of the more intensively cooled edge region is raised by intermediate heating (13) to at least said core temperature and finally cooled (14).

6 Claims, 1 Drawing Sheet

METHOD AND SYSTEM FOR THERMAL TREATMENT OF RAILS

Figure 1:
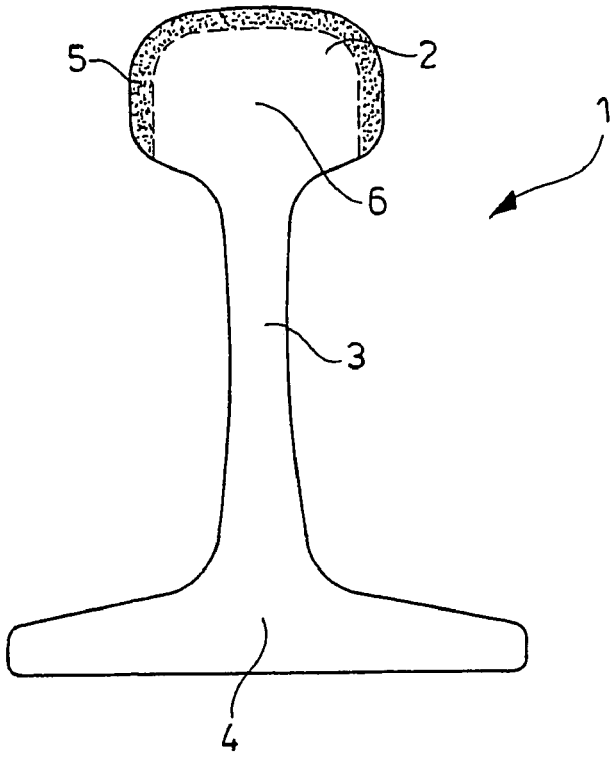

The invention relates to a method and an apparatus for the thermal treatment of rails, especially of hot-rolled carriageway or railway rails with profile parts [parts of the rail section] of different mass, whereby the rail from the rolling heat is subjected to a targeted thermal treatment and cooling for which the profile parts in certain regions of the profile [rail section], especially the head of the rail maintains a desired structure with enhanced strength.

It is known to cool rails from the rolling heat to a temperature below 80° on cooling beds. Because of the asymmetric distribution of the masses of the rail as a result of the different parts of the profile or section of the rail, between the head and foot of the rail there is a difference in the cooling conditions. The foot cools more quickly than the head, the result being that the rail can curve upon cooling. By prebending the still hot rail or utilizing a differential cooling process for the head and foot, this curvature can be anticipated and nullified. By the prebending or the differential cooling process, however, intrinsic stress is produced in the rail which disadvantageously affects its mechanical properties and thus its useful life.

In order to ensure a uniform cooling of the foot and head of the rail, it has been proposed in DE 42 37 991 A1 to transport the rail over the cooling bed with the head hanging down and it has been proposed in U.S. Pat. No. 468,788, further to dip the downwardly-hanging rail head in a water-filled tray completely or partly whereby the rail can be simultaneously pressed against a fixed support by pressure screws.

The [internal lattice or grain] structure transformation which occurs on cooling is described in EP 0 693 562 B1in which it is proposed that the rolled product have an average temperature of at most 1100° C., at least however 750° C., and be cooled in a first cooling unit after having been introduced transversely with uniformly local cooling intensity to a temperature between 860° C. and 5 to 120° C. in an argon atmosphere and then in a second cooling step with equal cooling intensity in the cross section but with the peripherally different cooling intensity depending upon the volume cooled; in the longitudinal direction of the rolled product heat is abstracted and as a result, there is a structure (lattice structure) reformation into a martensite-free fine perlite structure, after which in a subsequent step, again with the same local cooling intensity, the cooling down to room temperature is carried out.

From DE-C-30 06 695, a method is known in which the cooling is interrupted by an intermediate step with reheating and where initially the rails by rolling from the rolling heat are subjected to a transformation over their entire cross section, after which the rail heads, especially as a result of inductive heating are reaustenitized and then additionally are further cooled. As a result one obtains a fine lamellar perlite structure. However, there remains a danger of formation of undesirable proportions of bainite and martensite in the structure.

To avoid this, EP 0 187 904 B1 proposes apart from the addition of various alloying substances to initially heat the rail head in passing to a sufficient depth up to 50 mm by means of burners or inductively to an austenitizing temperature of 950 to 1050° C. and then to cool the rail head with compressed air in a first cooling stage within 10 to 20 seconds to 650 to 600° C. before the region of perlite transformation and in a second cooling stage with an air quantity which is throttled relative to that of the first cooling stage within 2 to 4 minutes to about 400° C. until the perlite transformation is complete and a fine lamellar perlitic structure is formed. Then the rail head is heated anew to 600 to 650° C. for a period of 4 to 6 minutes and then rapidly quenched to a temperature below 100° C.

Starting from this state of the art it is the object of the invention to provide a method and an apparatus by means of which a targeted thermal treatment is possible specifically during the cooling of the rail head and which, with simple means, enables a structure [lattice structure] to be created which has a fine lamellar perlite and which is characterized by a certain level of hardness and, connected therewith, with a high wear resistance and whereby during the cooling process, especially in the boundary zones of the rail head no bainite results.

The object set forth is achieved according to the method as a result of the aforedescribed type by the features of claim 1 which is characterized by the following sequence of method steps:

a) a targeted precooling of the rail from the rolling heat to a core temperature of the rail head of 750 to 850° C., b) a heating up of the boundary zone of the rail head to at least the core temperature, c) a finish cooling of the rail at such a high level of the heating current density that for the core zone of the rail head the shortest possible $t_{8/5}$ time (cooling time from 800 to 500° C. in the time-temperature conversion diagram) is achieved.

Through these method steps, carried out according to the invention, with initial targeting cooling and then a following reheating through which the cooled boundary zones are reheated at least to the core temperature, it is possible in the directly following cooling stretch, to establish a high heat flow density for the rail without the boundary zones or edge zones being cooled below the bainite starting temperature. As a result it can simultaneously be assured that, for the core zone the smallest possible $t_{8/5}$ time is reached. This means especially that the entire rail head is cooled so rapidly in the transformation zone that the desired fine lamellar perlite structure is produced.

An intervening undercooling of the boundary zone [edge zone] and a resulting premature transformation is thus hindered and the creation of bainite avoided. Simultaneously the temperature profile of the rail head before it enters the subsequent cooling stretch is homogenized so that both in the core zone of the rail head as well as in the boundary zone [edge zone] a similar transformation to the fine lamellar perlitic structure occurs.

Without the method approach of the present invention, the cooling stretch must be operated with a significantly lower heat flow density or the heat transfer coefficient must be 30 to 40% lower in order to avoid the bainite formation in the boundary zone [edge zone] of the rail head. The result is then for the core region a significantly longer $t_{8/5}$ time, a greater lamellar spacing and a reduced hardness value for the perlite structure as is associated therewith.

The targeted precooling to a core temperature of the rail head of 750 to 850° C. can be effected according to the invention by cooling down in air with natural convection or by a forced cooling with the aid of blowers. It is however also possible to effect the cooling with the aid of nozzles with a water/air mixture (aerosol cooling), whereby this cooling is preferably carried out on a transverse drag device with a corresponding number of resting places.

During the cooling process, the surface temperature is measured for example at the middle of the rail head in a contactless manner with the aid of a pyrometer. The here obtained boundary zone temperature [edge zone temperature] lies below the prevailing core temperature by some 30 to 60° C. depending upon the cooling type and intensity.

According to an advantageous refinement of the invention, the temperature of the rail head during the overall thermal treatment, starting from the entry to the precooling device until the rail leaves the finish cooling device is measured. The measured values are fed to a measurement and control device and serves for controlling the individual process steps as they are carried out, including the heating up prior to the finish cooling.

An apparatus for carrying out the method according to the invention is characterized by the following apparatus components:

a) a precooling device in which a targeted cooling of the rail from the rolling heat is effected to a core temperature of the rail head of 750 to 850° C., b) a heating device arranged immediately ahead of the finish cooling device, for example, having one or more induction coils which are traversed by the rail, c) a finish cooling device, for example a water-cooled stretch, in which the rail is rolled with such a high heat flow density that the shortest possible $t_{8/5}$ times (cooling time from 800 to 500° C. in the time-temperature diagram) is reached for the core zone.

Corresponding to an advantageous refinement of the invention, the cooling devices for the precooling and the finish cooling as well as the warming or heating device for the intermediate heating can be provided with a measurement and control device in which the temperature measurement values, especially for the rail head, are inputted and the entire thermal treatment is correspondingly controlled in order to establish the desired temperature or cooling down and heating up conditions and to maintain them.

A schematic illustration of an apparatus for the thermal treatment of a rail, for example, is illustrated in the drawing Figures which are diagrammatically presented below.

Figure 2:
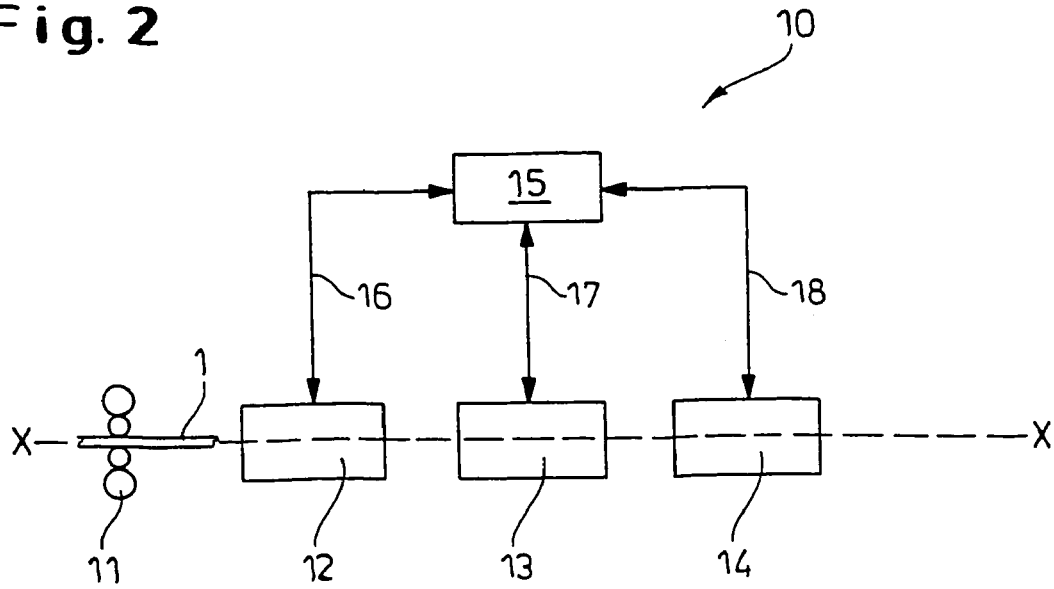

It shows:

FIG. 1 a rail in cross section,

FIG. 2 a thermal treatment apparatus in a flow diagram.

In FIG. 1 the cross section of a rail 1 is shown. The rail 1 is comprised of profile parts [sectional parts] of different mass, namely the rail head 2 with the boundary or edge zone 5 and the core zone 6, the middle part 3, and the rail foot 4. The edge zone 5 of the rail head has been delineated in broken lines; it is the region which primarily by the targeted thermal treatment should be converted into a fine lamellar perlite structure without the formation of bainite as a result of the thermal treatment in this edge zone or in this region 5.

In FIG. 2 an apparatus 10 is shown in schematic form for carrying out the thermal treatment according to the invention. The apparatus 10 comprises, in extension of the rolling line x-x downstream of the last rolling mill frame 11 in succession one after the other, a precooling device 12, a preferably inductive heating device 13 and a finish cooling device 14 which are in succession traversed by the rail 1 after it leaves the rolling mill frame 11. The control of the thermal treatment including the intensity of cooling and of heating as well as the speed with which the individual apparatus parts 12, 13, 14 are traversed is regulated by a measurement or regulation unit 15 in response to the respective measured temperature through corresponding conductors 16, 17, 18 for the measured temperature values and the control signals to the respective apparatus parts 12, 13, 14.

The illustrated embodiment of a thermal treatment apparatus can, it will be understood, be varied widely depending upon the kind and dimensions of the rails as well as the kind of cooling selected for the precooling and finish cooling and the nature of the measurement and control device and its circuitry, as long as the method steps according to the invention are carried out in succession as has been described.

REFERENCE CHARACTER LIST

1 Rail
2 Rail head
3 Middle part
4 Rail foot
5 Edge zone
6 Core zone
10 Thermal treatment apparatus
11 Rolling mill stand
12 Precooling device
13 Heating device
14 Finish cooling device
15 Control device
16 Conductor
17 Conductor
18 Conductor

The invention claimed is:

1. A method of thermally treating hot rolled carriageway or railway rails still hot from rolling heat and having profile parts of different mass, the method comprising the steps of sequentially:

targeted precooling the rail from the rolling heat to a core temperature of the rail head of 750 to 850° C., heating up edge zones of the rail head to at least the core temperature, and finish cooling the rail with such a high heat flow density that, for the core zone of the rail head the shortest possible cooling time from 800° C. to 500° C. in a time-temperature transformation diagram is achieved.

2. The method as defined in claim 1 wherein the targeted precooling of the rail depending upon the rail cross section is effected with air by natural convection cooling, as a forced cooling with the aid of blowers, or via nozzles with a water-air mixture.

3. The method as defined in claim 2 wherein during the during the targeted precooling step the surface temperature is measured in a contactless manner.

4. The method as defined in claim 3 wherein in addition to the temperature measurement during the precooling, the surface temperature is measured also during the heating and the finish cooling steps.

5. The method as defined in claim 3 wherein the measured temperature values are used with the aid of a measurement and control device to control the course in time and the intensity of the overall thermal treatment of the rail for the individual process steps.

6. A method of thermally treating hot rolled carriageway or railway rails still hot from rolling heat and having profile parts of different mass, the method comprising the steps of sequentially:

targeted precooling the rail from the rolling heat to a core temperature of the rail head of 750 to 850° C.;

heating up edge zones of the rail head to at least the core temperature; and finish cooling the rail through the transformation zone with such a high heat flow density that, for the core zone of the rail head the shortest possible cooling time from 800° C. to 500° C. in a time-temperature transformation diagram is achieved and so that a fine lamellar perlite structure is produced without thereby cooling the edge zones below the bainite starting temperature.

* * * * *